US012222186B2

(12) United States Patent
Keller et al.

(10) Patent No.: US 12,222,186 B2
(45) Date of Patent: Feb. 11, 2025

(54) FIREARM STOCK WITH CHEEK RISER AND METHODS

(71) Applicant: B5 Systems, Inc., Xenia, OH (US)

(72) Inventors: Mark J. Keller, Dayton, OH (US); Gabrielle M. Jackson, Kettering, OH (US)

(73) Assignee: B5 SYSTEMS, INC., Xenia, OH (US)

( * ) Notice: Subject to any disclaimer, the term of this patent is extended or adjusted under 35 U.S.C. 154(b) by 71 days.

(21) Appl. No.: 17/974,431

(22) Filed: Oct. 26, 2022

(65) Prior Publication Data

US 2023/0127332 A1 Apr. 27, 2023

Related U.S. Application Data

(60) Provisional application No. 63/272,003, filed on Oct. 26, 2021.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/04
See application file for complete search history.

(56) References Cited

U.S. PATENT DOCUMENTS 3,348,328 A * 10/1967 Earl ..... F41C 23/04 42/73
8,453,365 B1 * 6/2013 Ballard ..... F41C 23/14 42/74
9,091,505 B1 * 7/2015 Battaglia ..... F41C 23/20
9,261,324 B1 * 2/2016 Liang ..... F41C 23/04
9,464,863 B2 * 10/2016 Mather ..... F41C 23/14
11,365,952 B2 * 6/2022 Hopkins ..... F41C 23/14
11,624,583 B2 * 4/2023 Faifer ..... F41C 23/04 42/74
2009/0139128 A1 * 6/2009 Fluhr ..... F41C 23/04 42/71.01
2012/0000109 A1 * 1/2012 Zusman ..... F41C 23/14 42/71.01
2014/0196343 A1 * 7/2014 Wilson ..... F41A 35/06 42/71.01
2014/0259848 A1 * 9/2014 Chvala ..... F41C 23/14 42/73
2016/0202016 A1 * 7/2016 Mather ..... F41C 23/14 42/73

(Continued)

FOREIGN PATENT DOCUMENTS

DE 102009007137 A1 * 8/2010 ..... F41C 23/14
DE 202019100266 U1 * 5/2020

(Continued)

*Primary Examiner* — Jonathan C Weber
(74) *Attorney, Agent, or Firm* — Eversheds Sutherland (US) LLP

(57) ABSTRACT

A firearm stock is disclosed with an adjustable cheek riser, which includes an elevation mechanism and a cheek plate attached to a rising mechanism. In this manner, the cheek plate is adjustable in the vertical direction to provide fine adjustment to the height of the cheek plate with respect to the firearm stock. Aspects of the firearm stock include an adjustable stock that can provide adjustability for various firearms with regard to stock position and cheek plate position.

26 Claims, 20 Drawing Sheets

(56) References Cited

U.S. PATENT DOCUMENTS

| | | | | |
|---|---|---|---|---|
| 2017/0356718 | A1* | 12/2017 | Johnson | F41C 23/20 |
| 2018/0080736 | A1* | 3/2018 | Olsen | F41C 23/14 |
| 2019/0128639 | A1* | 5/2019 | Parker | F41C 23/04 |
| 2020/0182586 | A1* | 6/2020 | Zhang | F41C 23/20 |
| 2021/0018296 | A1* | 1/2021 | Faifer | F41C 23/04 |
| 2021/0048274 | A1* | 2/2021 | Hopkins | F41C 23/14 |
| 2021/0063111 | A1* | 3/2021 | Haugen | F41A 35/06 |
| 2021/0239423 | A1* | 8/2021 | Liptak | F41C 23/12 |
| 2023/0304771 | A1* | 9/2023 | Miller | F41C 23/14 |

FOREIGN PATENT DOCUMENTS

| | | | | |
|---|---|---|---|---|
| EP | 3683535 | A1 * | 7/2020 | F41C 23/04 |
| WO | WO-2019040014 | A2 * | 2/2019 | F41C 23/04 |
| WO | WO-2019129645 | A1 * | 7/2019 | F41A 35/06 |

* cited by examiner

FIREARM STOCK WITH CHEEK RISER AND METHODS

This application claims the benefit of U.S. Provisional Application No. 63/272,003 filed Oct. 26, 2021, the entire contents of which are hereby incorporated by reference herein.

TECHNICAL FIELD

The present application relates generally to firearm stock with cheek riser mechanisms.

BACKGROUND

Firearm cheek risers have been an integral and important part of modern firearms. Firearm cheek riser mechanisms increase comfort and accuracy when using a firearm. Adjustable cheek risers are able to adjust vertically to assist with centering the eye when aiming a firearm. Typical firearm cheek riser mechanisms use gears or other mechanisms that fail to "lock" the position into place. Cheek risers are often a separate piece that attaches to the outside of the stock with straps, screws, or snaps. Because cheek risers are often separate pieces from the stock, the adjustability is limited as they start a certain height off the stock.

BRIEF DESCRIPTION OF THE FIGURES

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings and some of the elements, components, and/or configurations illustrated in the drawings may not be present in certain examples.

DETAILED DESCRIPTION

The present disclosure provides for a firearm stock with an adjustable cheek riser, which includes an elevation mechanism and a cheek plate attached to a rising mechanism, as generally illustrated in FIGS. 1-30. In this manner, the cheek plate is adjustable in the vertical direction to provide fine adjustment to the height of the cheek plate with respect to the firearm stock. Aspects of the present disclosure describe an adjustable stock that can provide adjustability for various firearms with regard to stock position and cheek plate position. The device is reverse compatible, allowing it to be used with older firearms.

Figure 1:
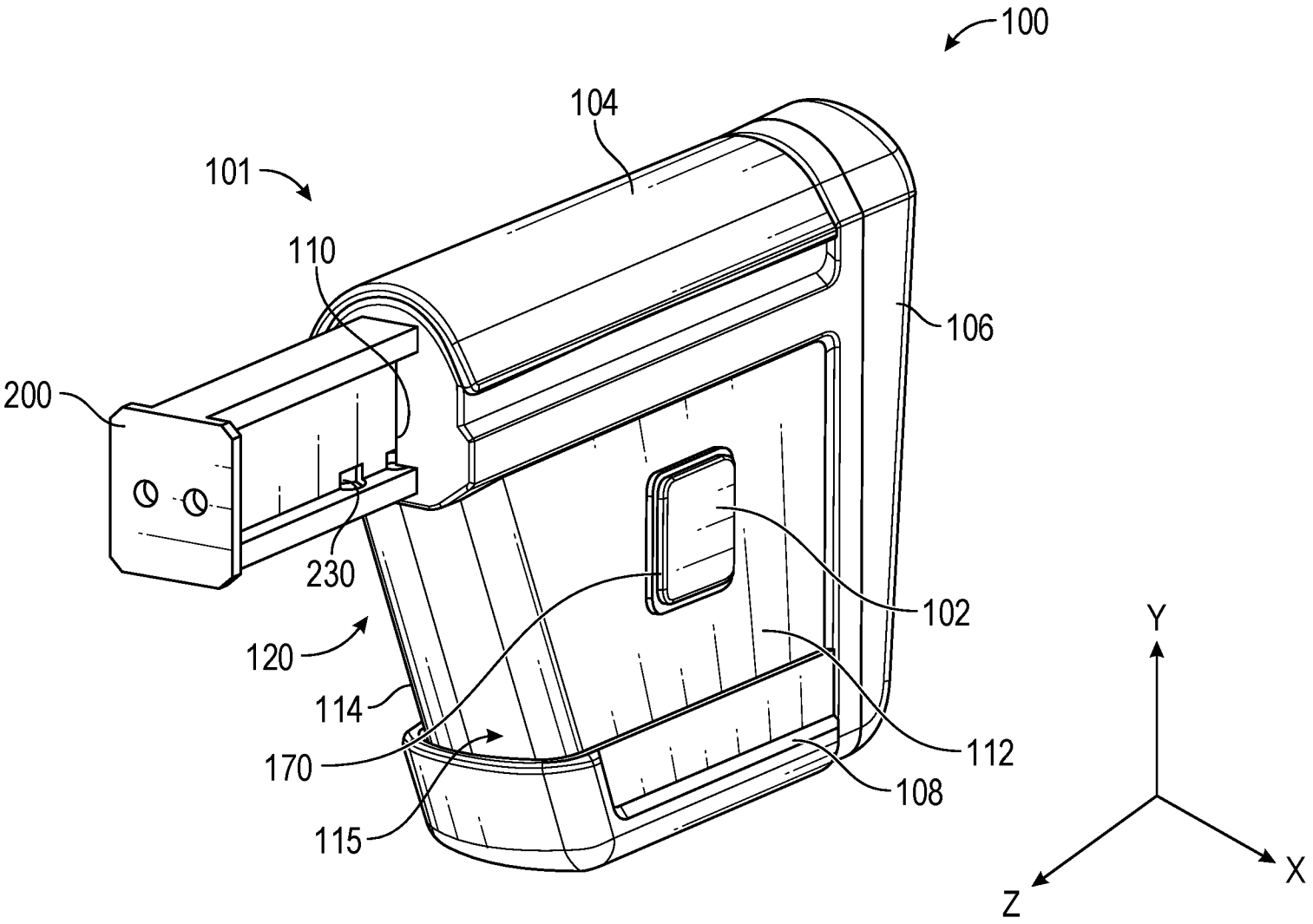
FIG. 1 is a front-right perspective view of a firearm stock with a cheek riser according to one or more examples of the disclosure.
Figure 2:
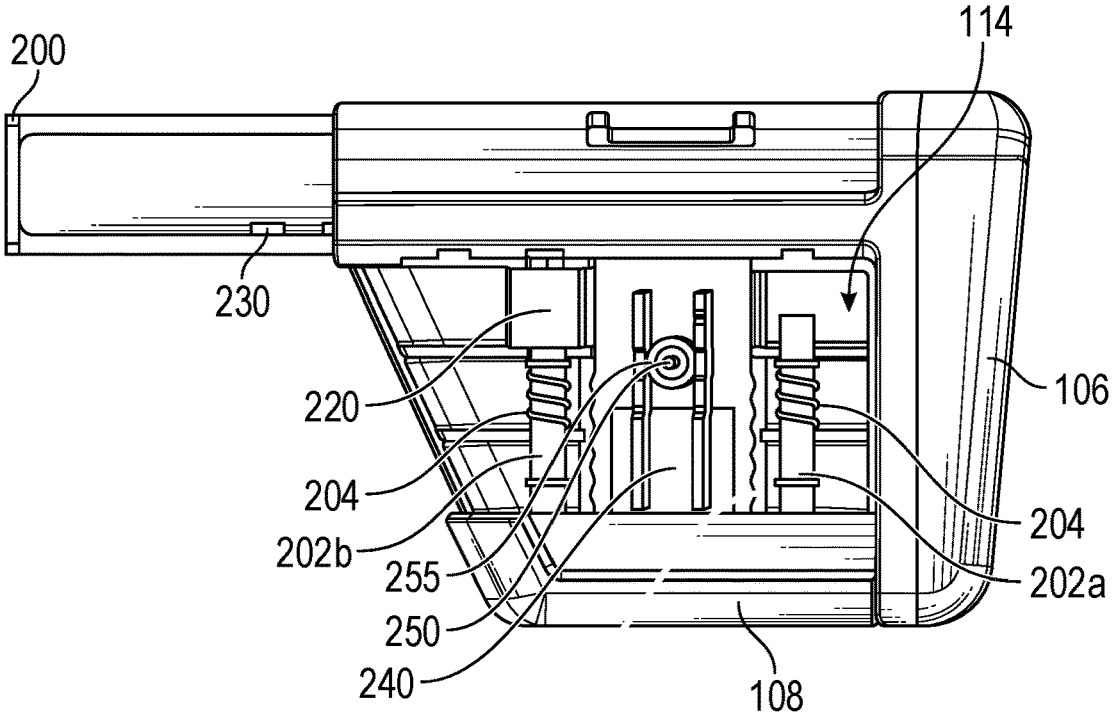
FIG. 2 is a side view with one side missing of a firearm stock with a cheek riser according to one or more examples of the disclosure.

FIG. 1 illustrates a front-right perspective view of a firearm stock 100 shown with a cheek riser 101, which may be adjustable in height according to embodiments of the present disclosure. FIG. 2 shows a partial side view of a firearm stock with one side omitted for clarity and view of internal parts of an adjustment riser mechanism. FIG. 2 illustrates an adjustable riser mechanism according to one or more examples of the disclosure. FIGS. 1 and 2 may be discussed in conjunction with one another.

With reference to FIG. 1, the stock 100 may include a cheek riser 101 having a cheek plate 104, and a bottom plate 108 disposed at a bottom portion of the stock 100. The stock 100 is illustrated in FIG. 1 indicating a first side 112, a second side 114, a rear plate 106, a bottom plate 108, and a front side 115. A slot 110 is disposed on the front side 115 into which a firearm frame member 200 may fit. One or more embodiments of the adjustable cheek riser 100 are disclosed herein.

Length Adjustment as Shown in FIGS. 1-4

In some embodiments, the stock 100 may include the side button 102 disposed in the first side 112 of the stock 100, a cheek plate 104 disposed on a top side of the stock, a rear plate 106 disposed at a distal end of the stock 100, and a bottom plate 108 disposed at an underside of the stock 100, where the bottom plate 108 of the stock 100 is configured to provide mechanism(s) for adjustment of rods. FIG. 1 further illustrates a second side 114, where the first side 112, second side 114, rear plate 106, and front side 115 of the stock at least partially form a body 120 of the stock. The stock 100 may be configured from any materials compatible with a firearms stock, including for example, wood, metal, plastic or other synthetic materials, composites, or any combination thereof.

According to embodiments of the present disclosure, the adjustable stock 100 may provide length customization of the firearm length as well as the customization of the height of the cheek plate 104, which may increase marksmanship, reliability of the device, and ease of use for firearm users.

In some embodiments, the adjustable cheek riser 101 may include a cheek plate 104. FIG. 1 illustrates only the cheek plate 104 portion of the riser mechanism described below, as the cheek plate 104 is visible from the outside of the assembled stock 100.

As shown in FIGS. 1-4, the side button 102 may be disposed within a first side 112 of the stock 100, which may be actuated to provide adjustable height for the cheek plate 104. A lip 170 may surround a periphery of the button 102, which may prevent debris from entering the stock and interfering with the adjustment mechanism (illustrated with respect to FIGS. 2 and 3).

As shown in FIGS. 1-4, the cheek plate 104 may form a semispherical, ovular, or other shaped cross section. The cheek plate 104 may comprise metal, wood, plastic, leather, or a combination of any suitable materials. The cheek plate 104 is used to center the eye with respect to a sight to improve comfort and accuracy when using a firearm. The cheek plate 104 may be compatible with other adjustment mechanisms, such as functioning on a mounting plate for horizontal movement along a plane extending from the front side 115 to the rear plate 106.

As shown in FIGS. 1-4, the rear plate 106 of the stock 100 may be adjustable and configured to expand and collapse axially relative to the stock, as well as move up or down independent of the stock body. The rear plate 106 of the stock 100 may further comprise rods, pins, or other mechanisms to allow the rear plate to extend from an expanded position to a collapsed position.

Figure 3:
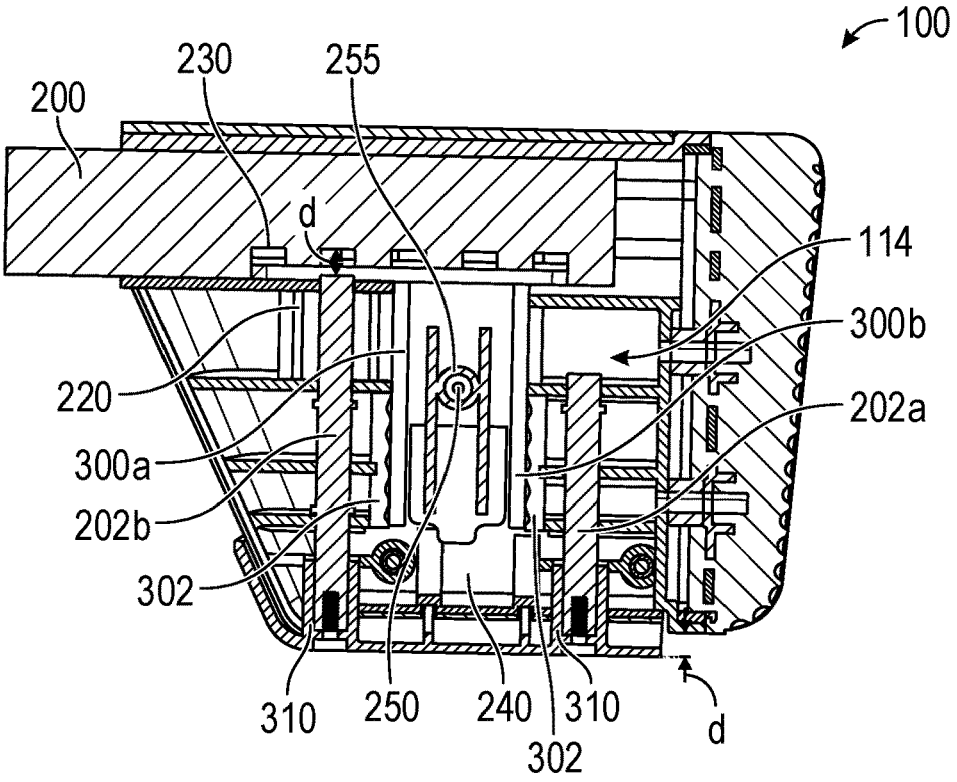
FIG. 3 is a cross section from the right of a firearm stock with a cheek riser with the bottom of the stock in a first position according to one or more examples of the disclosure.

As shown in FIGS. 1-4, the bottom plate 108 of the stock 100 is configured to move vertically between a first position, as shown in FIG. 2, and a second position, as shown in FIG. 3, where the difference between the first and second position is represented by d. The bottom plate 108 of the stock is connected to rods 202 and 202*b* that are rigidly connected with the bottom plate 108 and will rise and fall with the movement of the bottom plate 108 of the stock 100. The bottom plate 108 of the stock 100 may be attached to the stock by these rods 202 as well. The bottom plate 108 may be spring loaded to resist movement from the first position to the second position.

As shown in FIGS. 1-4, a slot 110 is disposed on the front side 115 of the stock 100 for receiving a firearm frame member 200, such as an I-beam to connect the stock to the firearm. The slot 110 may be I-shaped to receive an I-shaped firearm frame member 200. The I-shape provides better stability due to the increased surface area to volume ratio. The slot 110 and firearm frame member 200 may be any other shape compatible and used for connecting firearm stocks to firearms, such as ovular, circular, square, or any other shape.

As shown in FIGS. 1-4, in some embodiments, the first side 112 of the stock 100 comprises one side of the stock and accompanying internal skeleton. The first side 112 of the stock 100 has a side button 102 disposed on it that may extend through to the inside of the stock 100. The first side of the stock may be configured to connect to the second side of the stock to form a body 120.

As shown in FIGS. 1-4 in some embodiments, the second side 114 of the stock 100 comprises a second side of the stock and accompanying internal skeleton. The combination of the first side 112 and second side 114 together may form the body 120 of the stock, and thus the front side 115 and rear plate 106 as well.

Figure 16:
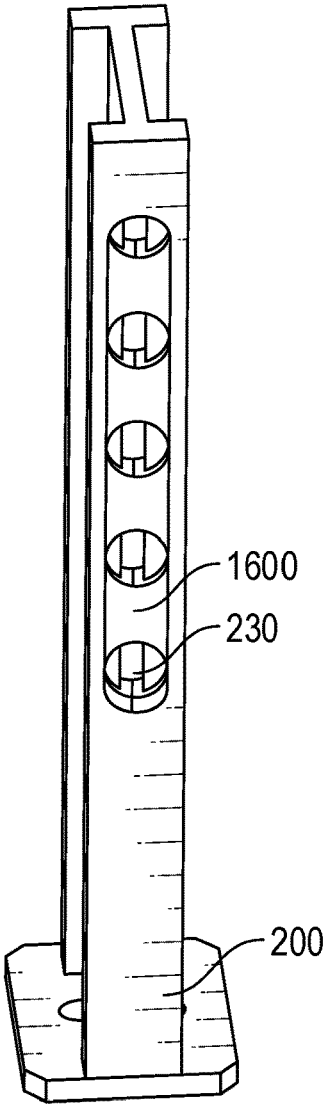
FIG. 16 is a bottom perspective view of an I-beam insert according to one or more examples of the disclosure.
Figure 17:
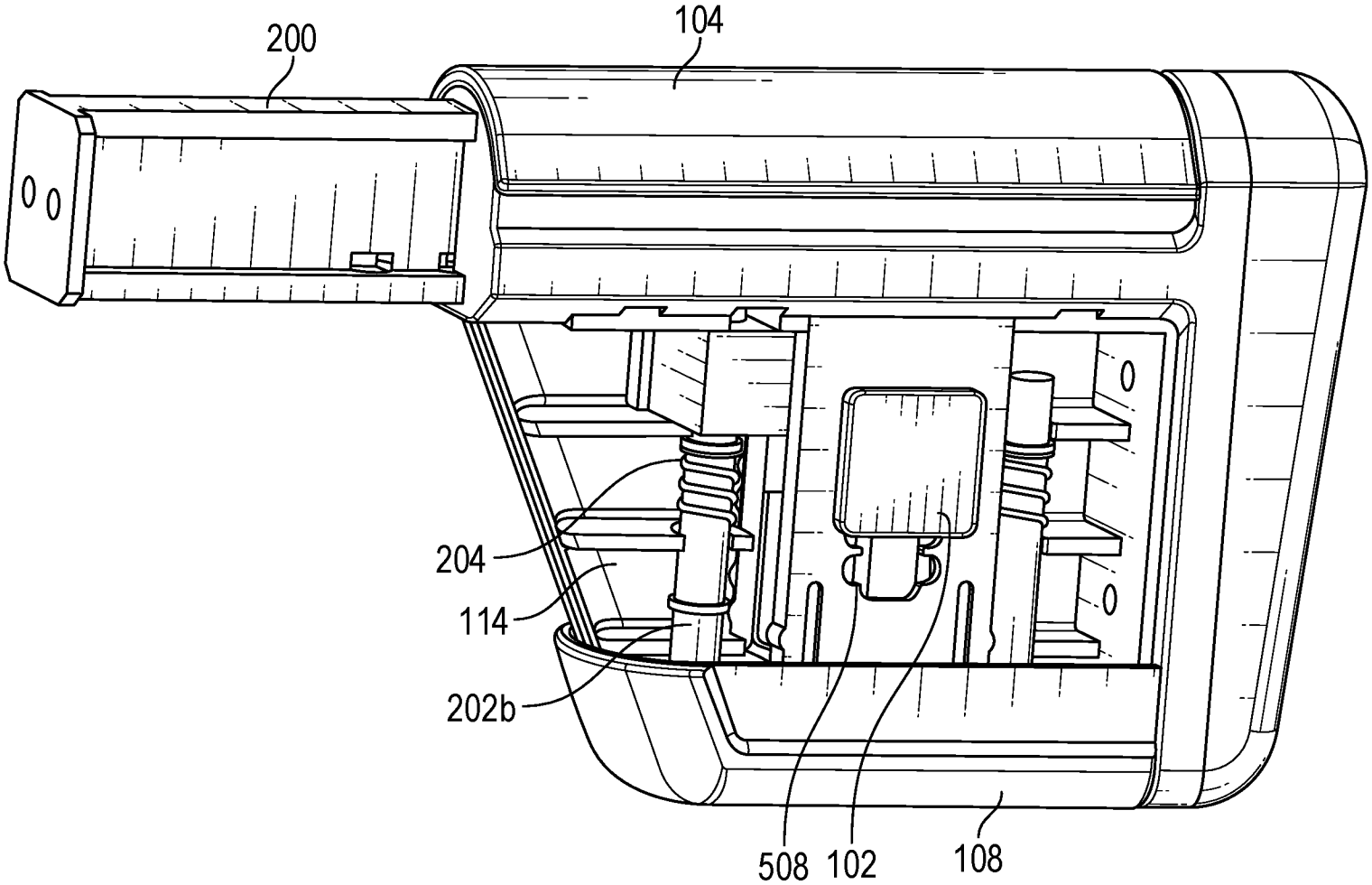
FIG. 17 is a side perspective view of a firearm stock with a cheek riser with one side removed according to one or more examples of the disclosure.
Figure 18:
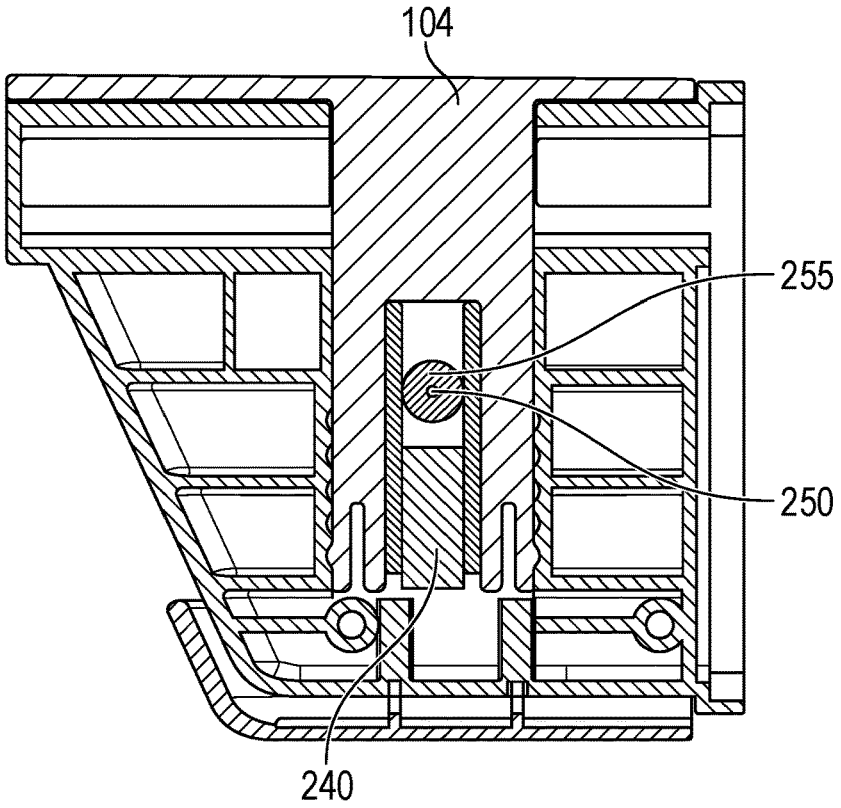
FIG. 18 is a cross-section view of a firearm stock according to one or more examples of the disclosure.
Figure 19:
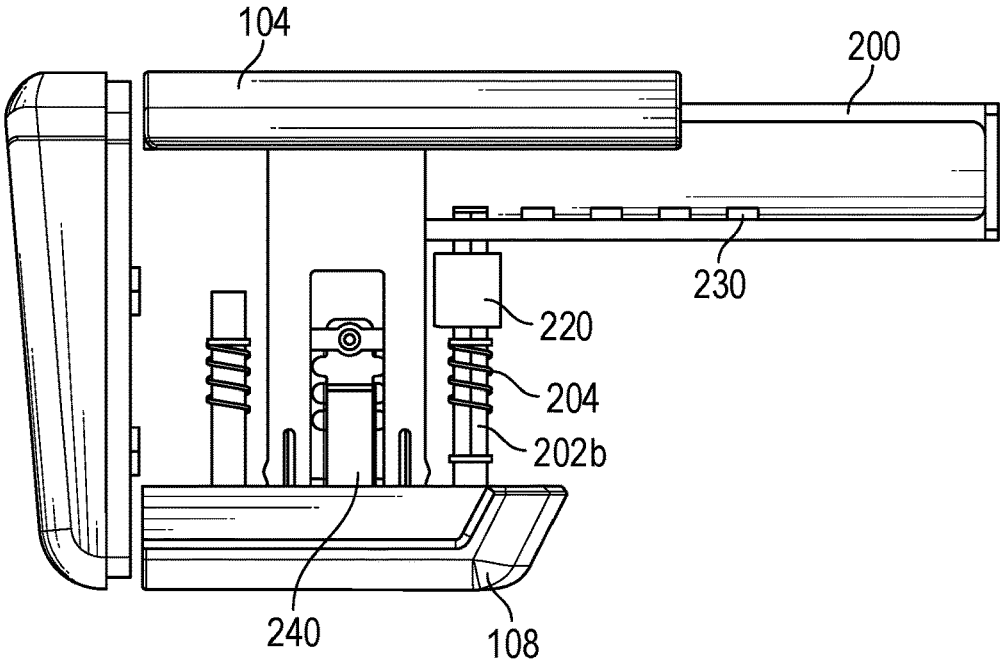
FIG. 19 is a side view of a firearm stock with a cheek riser with both sides removed according to one or more examples of the disclosure.
Figure 20:
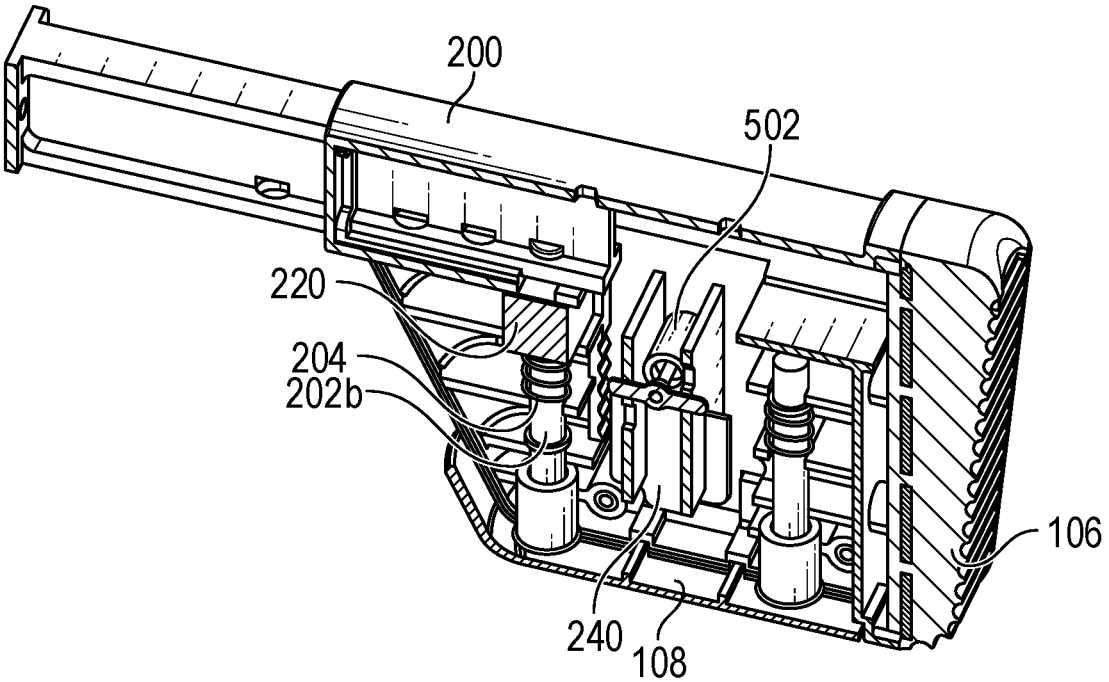
FIG. 20 is a cross-section view of a firearm stock according to one or more examples of the disclosure.
Figure 21:
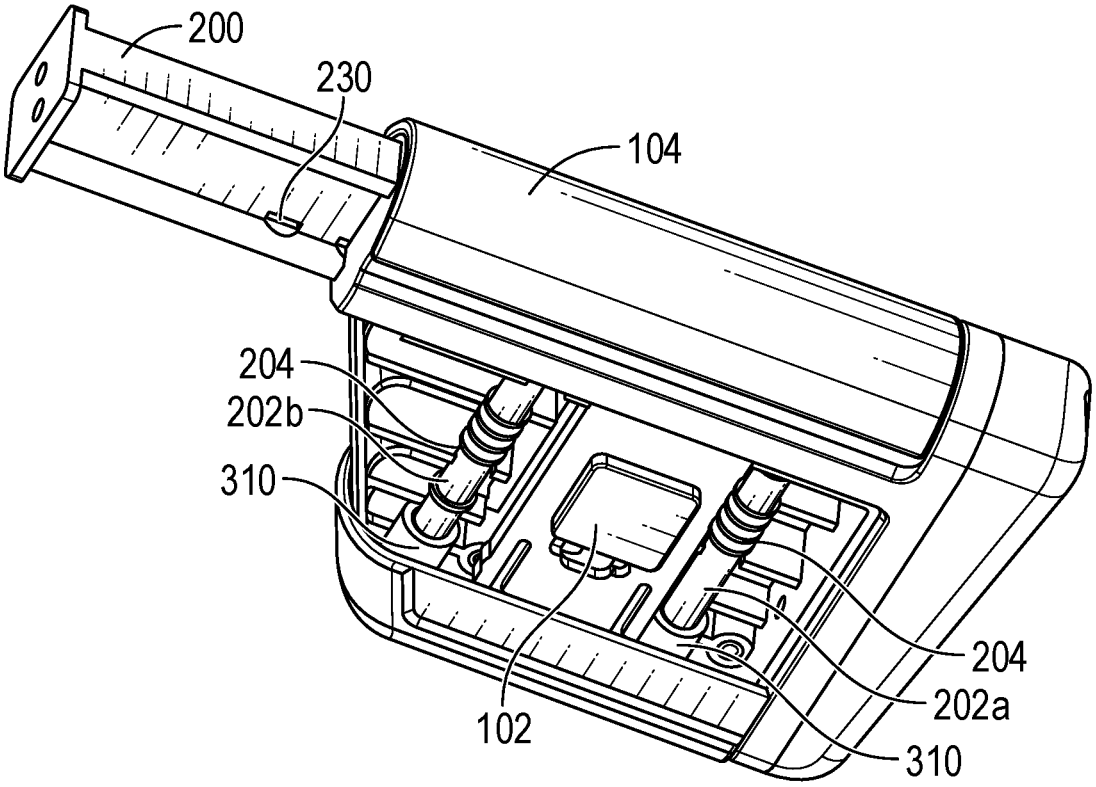
FIG. 21 is a side perspective view of a firearm stock with one side removed according to one or more examples of the disclosure.
Figure 22:
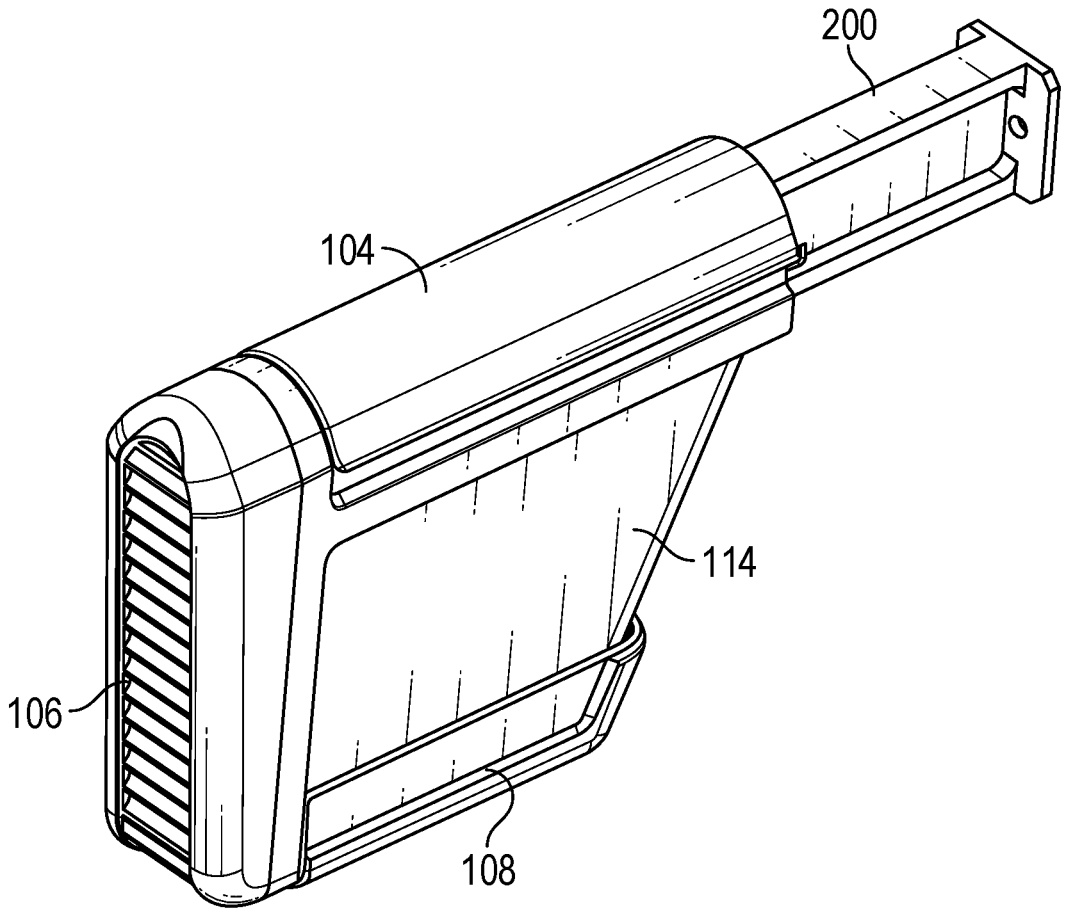
FIG. 22 is a rear perspective view of a firearm stock according to one or more examples of the disclosure.

As shown in FIGS. 1-4, in some embodiments, the firearm frame member 200 is I-shaped and comprises a series of bores 230 (e.g., 2, 3, 5, or more bores) that provide axially indexed adjustable positioning of the adjustable stock 100 for the rods 202 to securely fit within them for adjustment of the stock along direct axially positions of the firearm frame member 200. The firearm frame member 200 may slide axially within the slot 110 to adjust the distance of the adjustable stock 100 from the attached firearm, often referred to as the length of pull. The firearm frame member 200 can move between a first position, as shown in FIG. 2, and a second position, as shown in FIG. 3, with the possibility of other positions relative to other bores 230. As shown in FIG. 16, the bottom of the firearm frame member 200 may comprise a recess or passage 1600 along which the rods 202 travel when the bottom plate 108 is in the second position, and a plurality of bores 230 that further secures the rods 202 to the firearm frame member 200.

Figure 4:
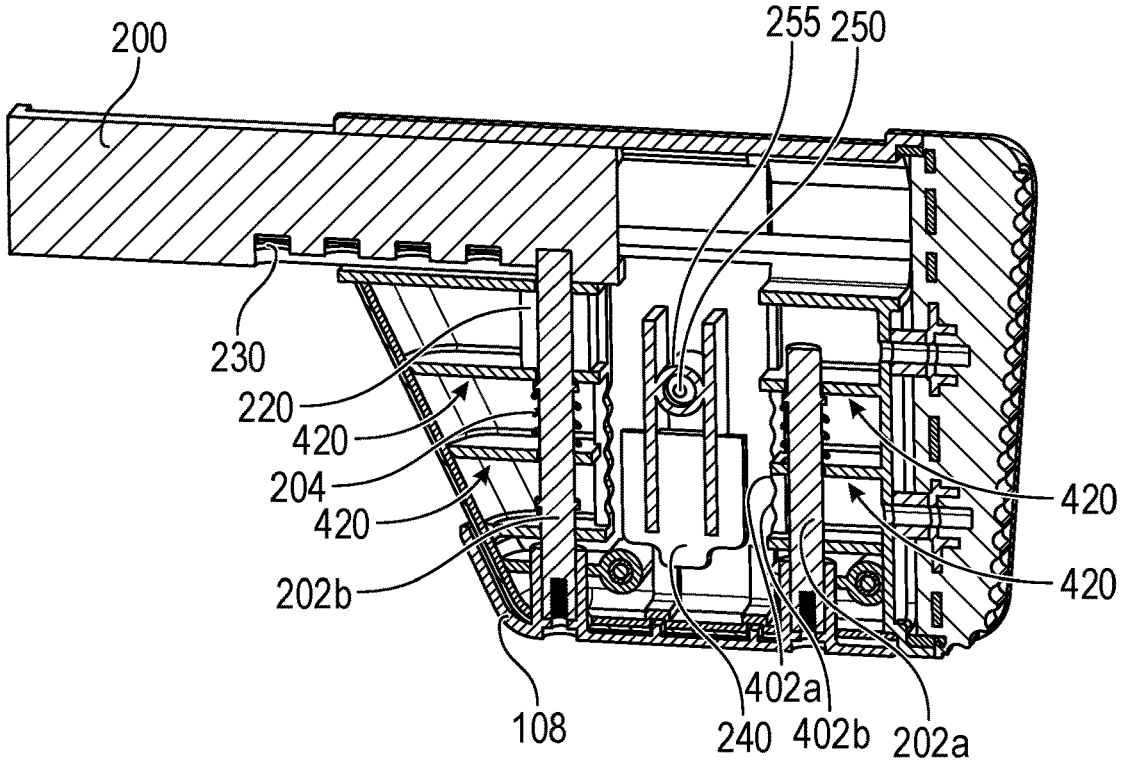
FIG. 4 is a cross section from the right with the I-beam extended of a firearm stock with a cheek riser with the bottom of the stock in a second position according to one or more examples of the disclosure.
Figure 23:
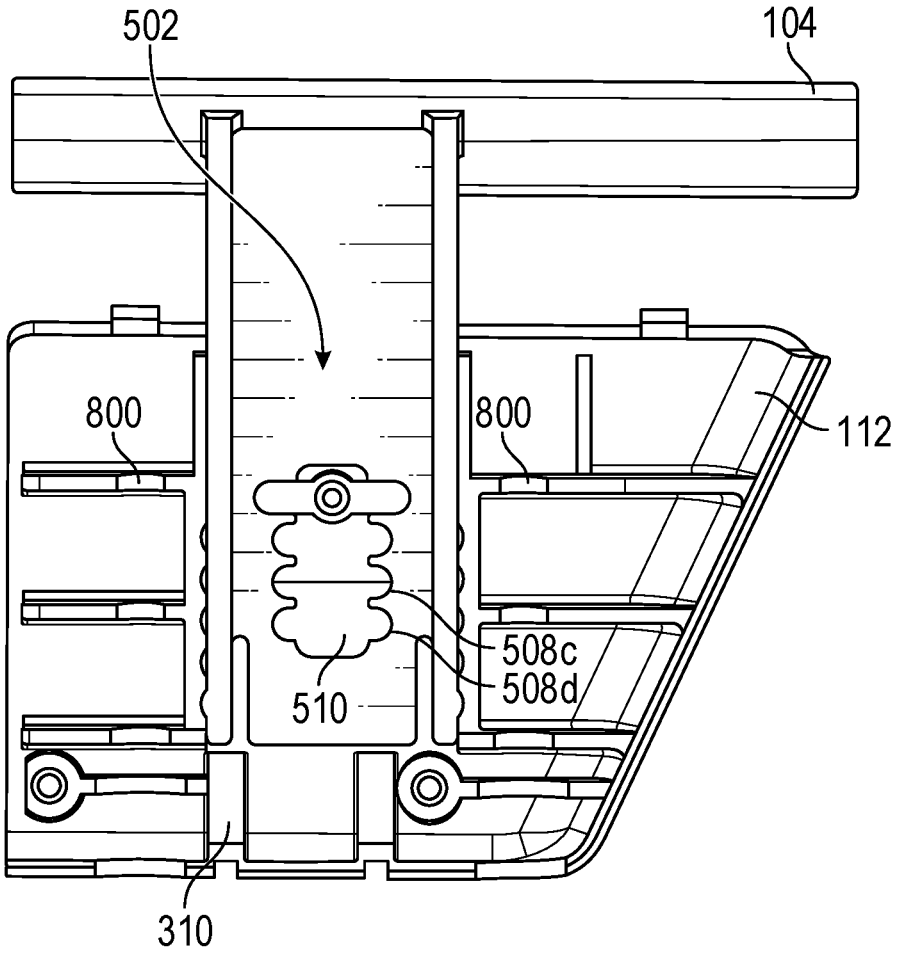
FIG. 23 is a cross section view of a firearm stock according to one or more examples of the disclosure.
Figure 29:
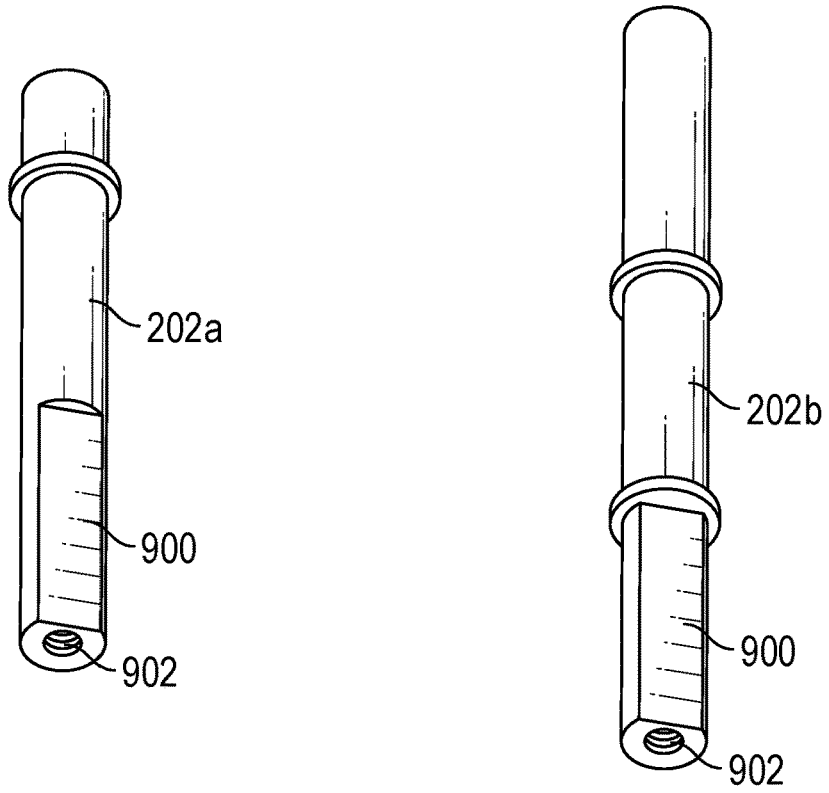
FIG. 29 is a view of the rods according to one or more examples of the disclosure.
Figure 30:
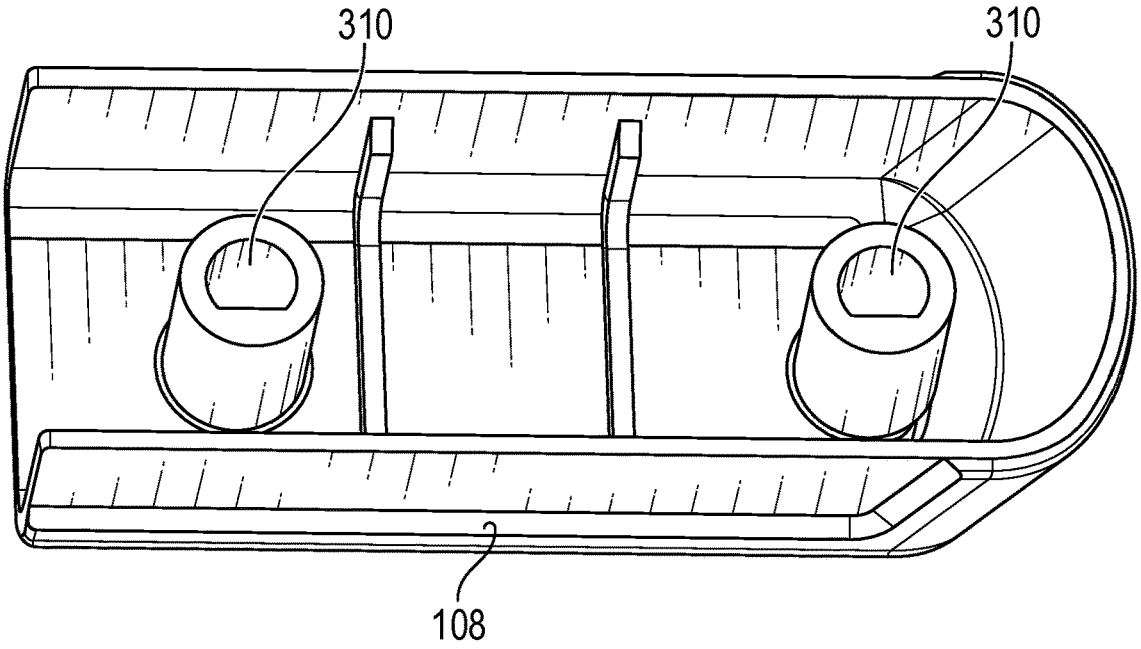
FIG. 30 is a top view of the bottom plate according to one or more examples of the disclosure.

As shown in FIGS. 2-4, in some embodiments, the rods 202 are disposed within the stock 100 and attached to the bottom plate 108 of the stock. The rods 202 may further be disposed inside springs 204 configured to resist vertical movement of the rods 202 in a vertical direction, that is, the bottom plate 108 is biased into the first position, requiring a force to compress the springs 204 to move the bottom plate into the second position. The rods 202 may be configured to translate vertically to fit into bores 230 of the firearm frame member 200. The rods 202 may translate by moving the bottom plate 108 of the stock 100 from a first position to a second position. The rods 202 may further be disposed inside of a guide 220 disposed inside the stock. As shown in FIG. 2, the rods may consist of a first rod 202*a* and a second rod 202*b*. The first rod 202*a* may be configured not to translate vertically to fit into bores 230 of the firearm frame member 200. The first rod 202*a* in this embodiment exists to provide stability to the bottom plate 108 and ensure alignment of both rods 202*a*, 202*b*. As shown in FIG. 23, the rods are disposed within channels 800 that may be disposed within the first side 112, second side 114, or both sides. The rods may further be a non-uniform shape as shown in FIG. 29, where a section 900 of the rods is configured to fit within the notches 310, as shown in FIG. 30, disposed in the bottom plate 108. The rods 202 may further comprise screw holes 902 to secure the rods 202 to the bottom plate 108.

As shown in FIGS. 2 and 4, in some embodiments, the springs 204 have the rods 202 disposed inside of them and are configured to adjust or bias the rods 202 and, by extension, the bottom plate 108 of the stock 100 back into a first position by resisting vertical movement of the rods from the first position. As shown in FIG. 4, the springs 204 are configured to adjust the rods 202 by compressing against an internal skeleton 420 of the first side 112, second side 114, or both.

As shown in FIGS. 2-4, the guide 220 may be disposed in the first side 112, second side 114, or both.

As shown in FIGS. 1-4, bores 230 may be disposed within the firearm frame member 200. These bores 230 may be of any size, shape, and depth suitable to receive the rods 202 inside them. The bores 230 may be any number of bores 230 to correspond to various positions and allow the firearm frame member 200 to be set in at least one position where 202*b* is received with a bore 230.

As shown in FIGS. 2-4, a key 240 may be disposed within the second side 114. This key may be configured to slide along internal rails. A button protrusion 255 may be disposed within the second side 114. This protrusion may include a pinhole 250 proximal to its center.

Figure 5:
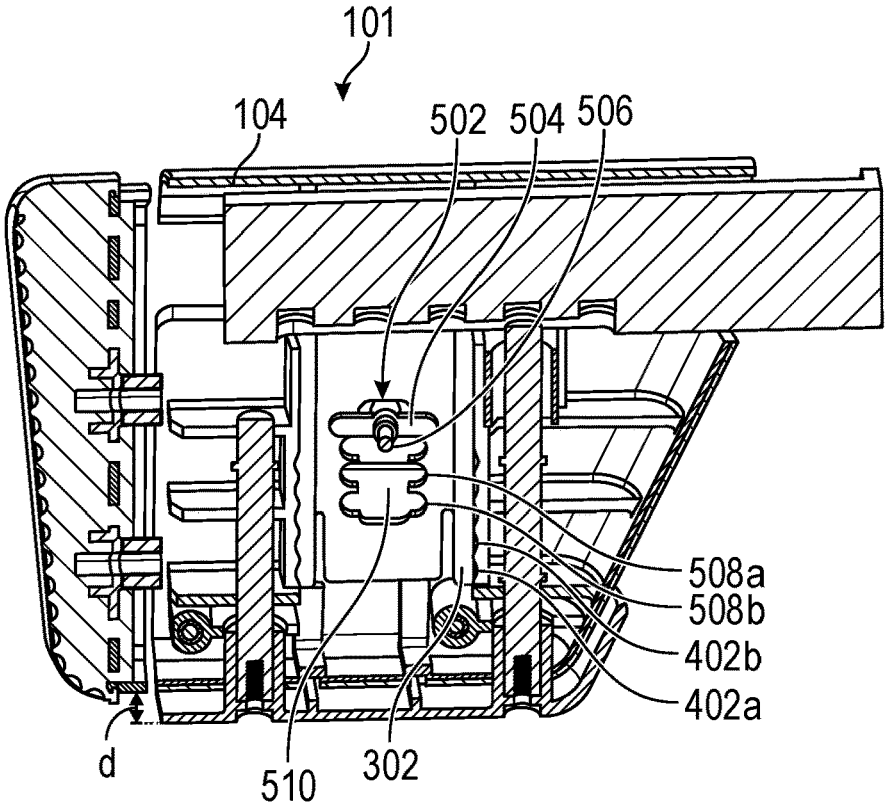
FIG. 5 is cross section view from the left side with the bottom plate in a second position of a firearm stock with a cheek riser according to one or more examples of the disclosure.

As shown in FIGS. 2 and 3, a user (not shown in FIG. 2) may apply downward force to the bottom plate 108 may by pulling the bottom plate from a first position, downwards by a distance d to a second position, to remove the rods 202 from the bores 230. Once the rod 202*b* is pulled from the bore 230 (as shown in FIG. 5) the firearm frame member 200 becomes disengaged may slide horizontally into or out of the slot 110 to place the firearm frame member in a different position that suits the user. The bottom plate 108 is then released, and the springs 204 disposed around the rods 202 resist against the skeleton 420 of the first side 112 and second side 114 to return the bottom plate 108 and rods 202 to the first position, wherein the rods insert into a different bore of the bores 230. In this regard, rod 202*a* provides for alignment of the bottom plate 108 relative to the body 120.

Vertical Adjustment as Shown in FIGS. 3-8.

Figure 6:
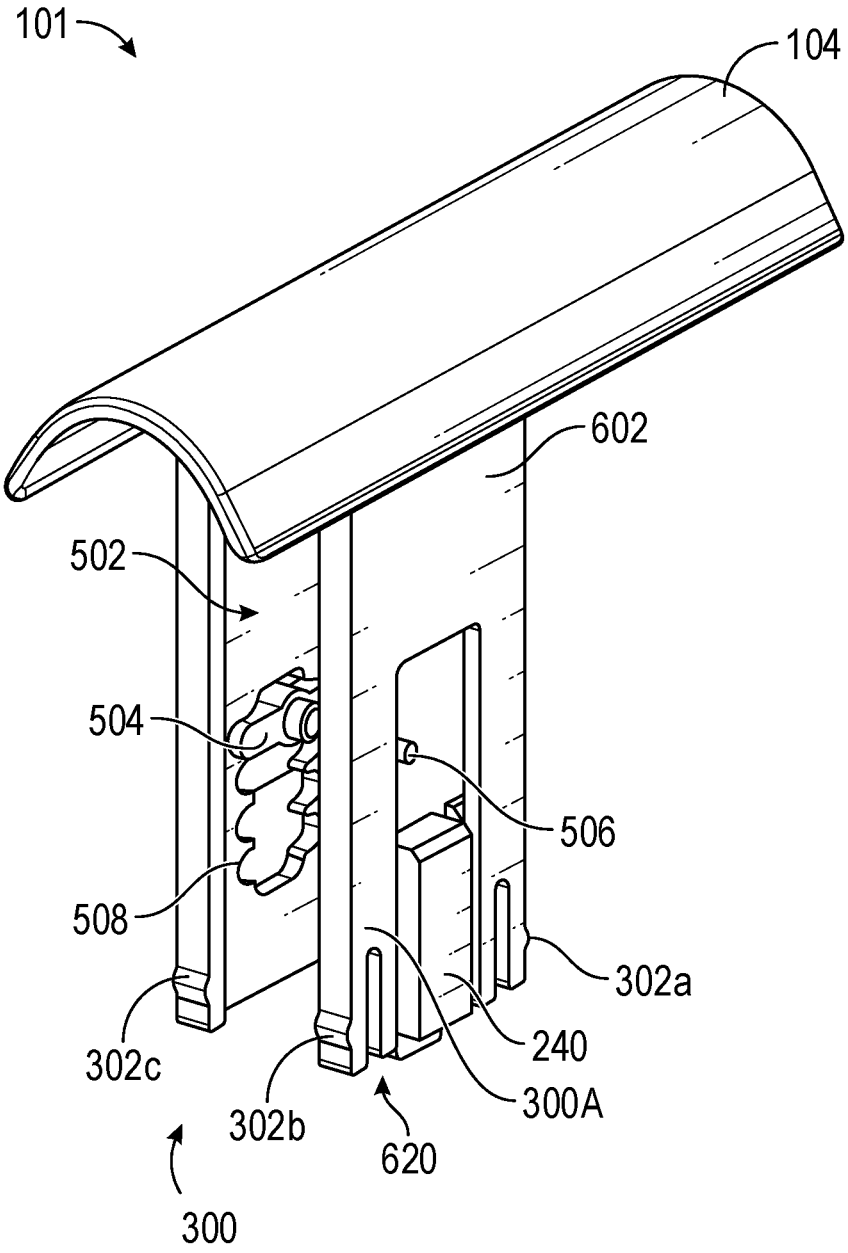
FIG. 6 is a perspective view of the rising mechanism of a firearm stock with a cheek riser according to one or more examples of the disclosure.

As shown in FIGS. 5-6, the cheek riser 101 includes a cheek plate 104 connected to a rising mechanism 602. The adjustable cheek riser 101 is configured to allow for vertical adjustment of the cheek plate 104 but coupling with a button mechanism 502 and key 240.

As shown in FIG. 6, in some embodiments, the rising mechanism 602 may have multiple deformable U shaped legs 300*a*, 300*b* extending from the main rising mechanism. The rising mechanism 602 may also have various apertures 508 connected by a channel 510 disposed to connect the apertures.

As shown in FIG. 6, in some embodiments the deformable U shaped legs 300*a*, 300*b* further comprise a slit 620 that may be compressible, allowing the deformable U shaped legs 300*a*, 300*b*, to compress at the ends. In some embodiments, the key 240 may be inserted between the deformable U shaped legs 300*a*, 300*b* to prevent over compression. The key 240 may also be disposed such that the button protrusion 255 is above and connected to it, so that as the adjustable cheek riser 101 moves vertically, the button protrusion 255 and pinhole 250 raise vertically to stay aligned with the pin.

As shown in FIG. 6, the deformable U shaped legs 300*a*, 300*b*, may further have a protrusion 302*a*, 302*b* disposed on the leg. The protrusion 302 may be configured to fit within a ridge 402 disposed on the inside of the first side 112 or second side 114.

Figure 24:
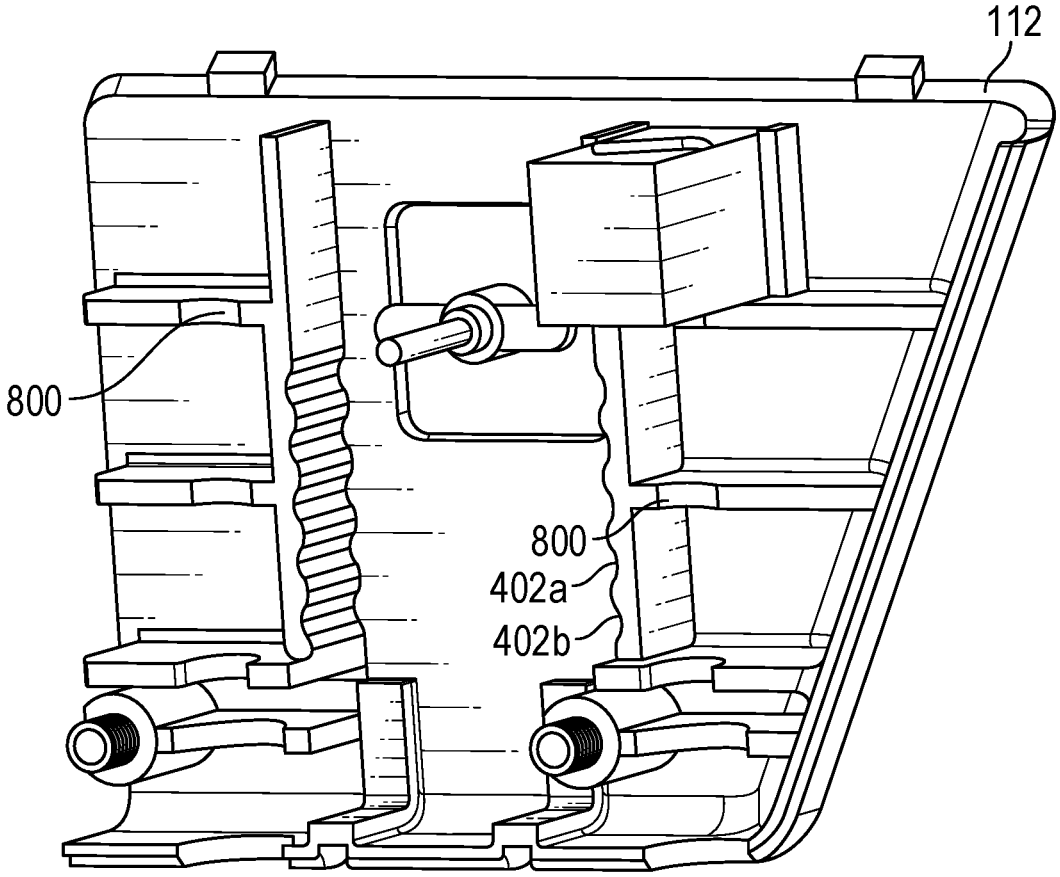
FIG. 24 is an internal side view of one side of a firearm stock according to one or more examples of the disclosure.
Figure 25:
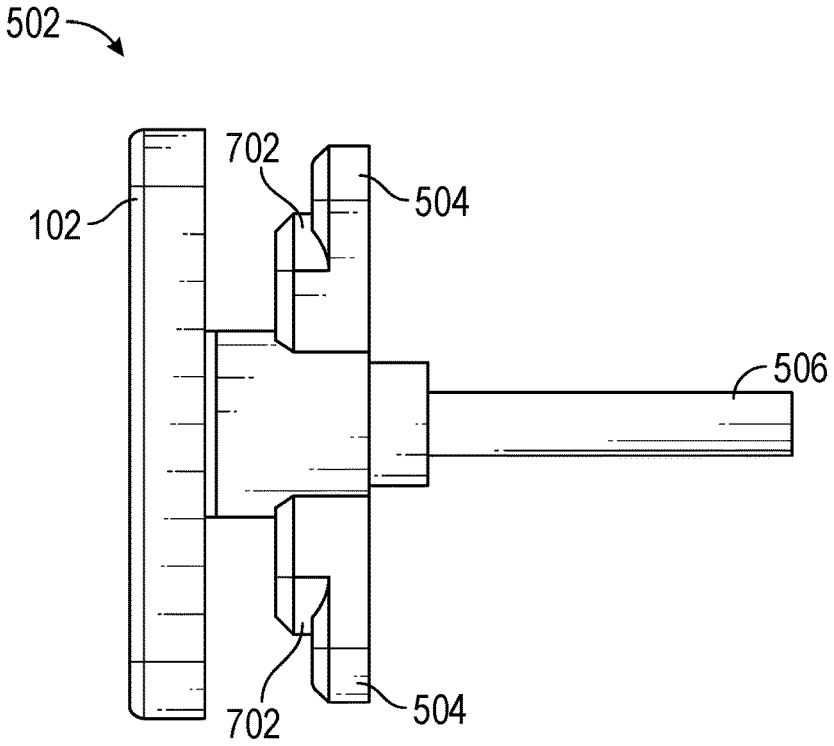
FIG. 25 is a view of a button according to one or more examples of the disclosure.
Figure 26:
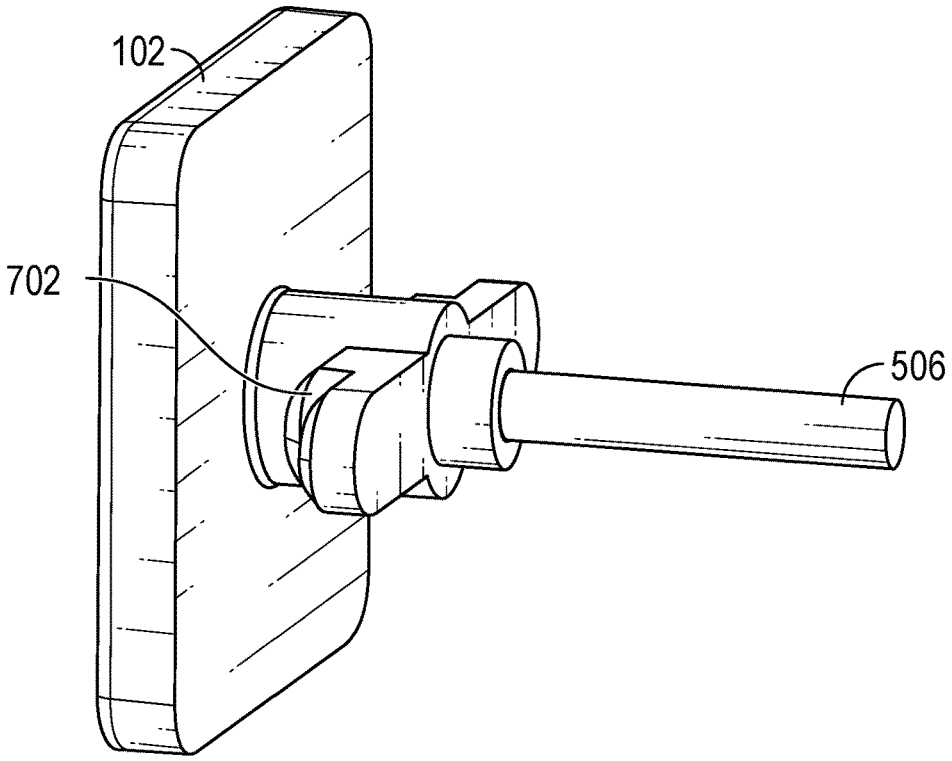
FIG. 26 is a perspective view of a button according to one or more examples of the disclosure.
Figure 27:
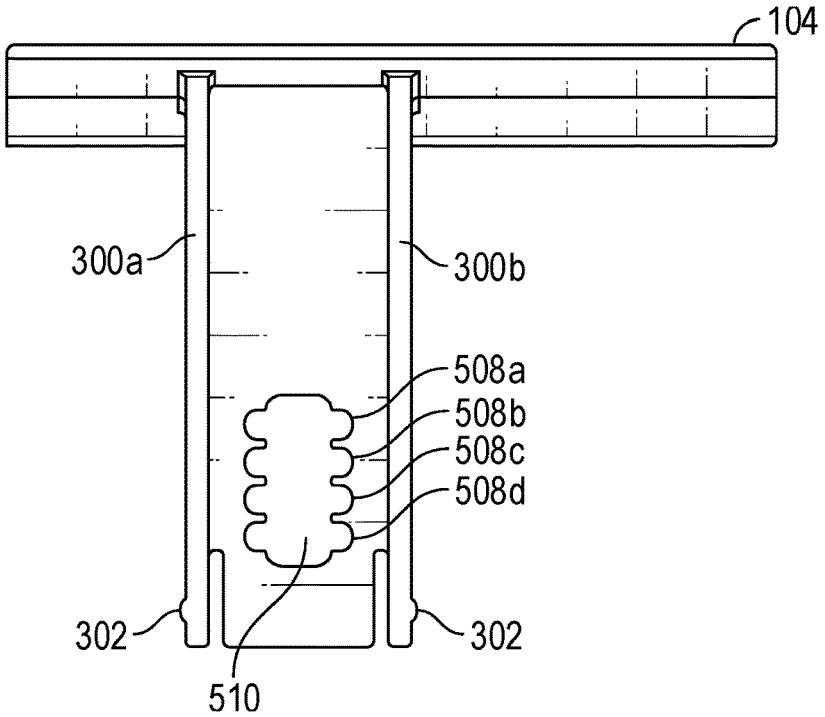
FIG. 27 is a cross section view of the rising mechanism according to one or more examples of the disclosure.
Figure 28:
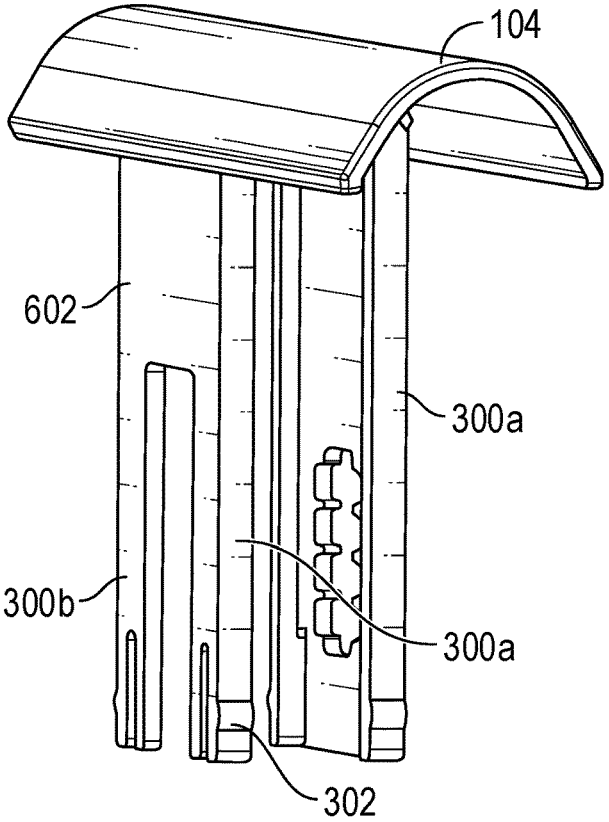
FIG. 28 is a perspective view of the rising mechanism according to one or more examples of the disclosure.

As shown in FIG. 5 and FIG. 24, ridges 402 may be set inside of the first side 112 or second side 114. These ridges 402 are configured to receive the protrusion 302 between adjacent ridges, though reference herein may be made to singles ridges with the understanding the protrusions will rest between adjacent ridges. These ridges 402 may run vertically along a portion of the inside of the body 120. When the adjustable cheek riser 101 moves vertically, the protrusion 302 and ridges 402*a* may be configured so that the vertical force is turned into horizontal force, compressing the slits 620 of the legs and thus moving the protrusion 302 into a different ridge 602*b*, where the slits 620 expand against the key 240 and legs 300 expand again.

As shown in FIG. 5, in some embodiments, a button mechanism 502 may be configured to allow for the vertical adjustment of the adjustable cheek riser 101. The button mechanism 502, as shown in FIG. 7, may have a side button 102, a first set of wings 702, a second set of wings 504, a pin 506, a pinhole 250, and the button protrusion 255.

As shown in FIG. 5, in some embodiments, the second set of wings 504 may extend beyond the aperture 508. The second set of wings 504 may be larger than the first set of wings 702. The second set of wings are configured to limit a position of the button mechanism 502 while the button mechanism 502 and the pin 506 is biased in an extended position as shown in FIG. 7.

Figure 7:
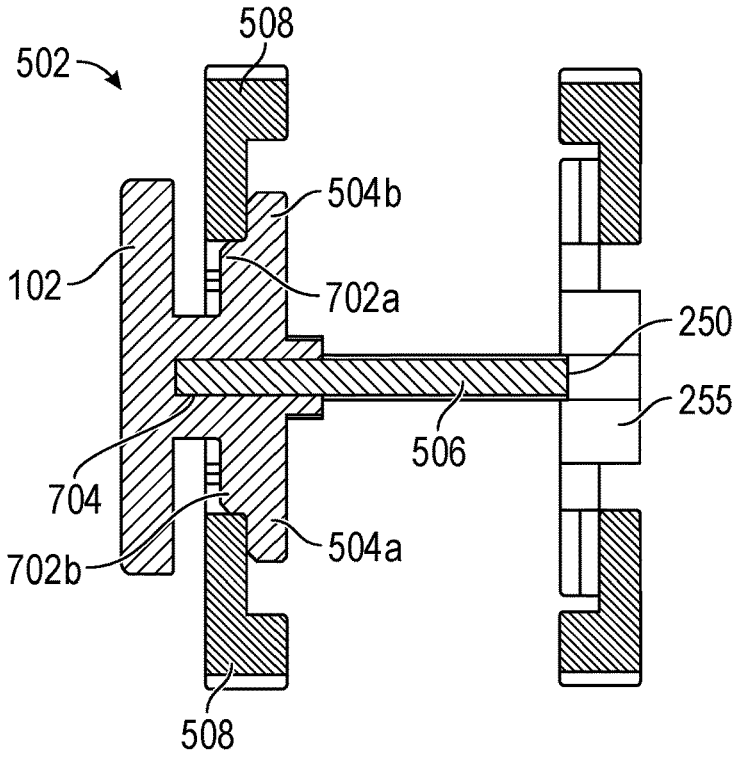
FIG. 7 a cross-section view of the button mechanism in a first position of a firearm stock with a cheek riser according to one or more examples of the disclosure.
Figure 8:
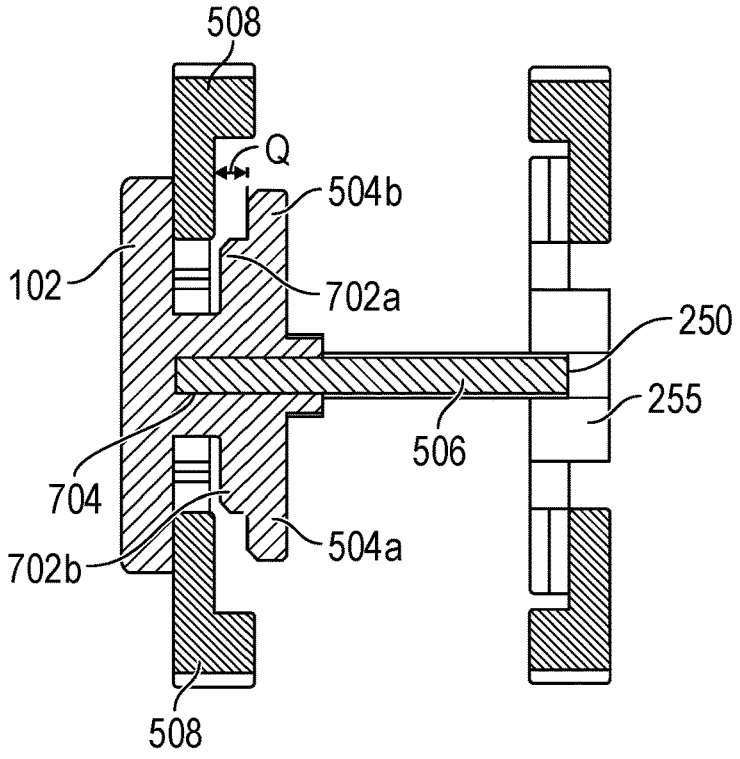
FIG. 8 a cross-section view of the button mechanism in a second position of a firearm stock with a cheek riser according to one or more examples of the disclosure.
Figure 9:
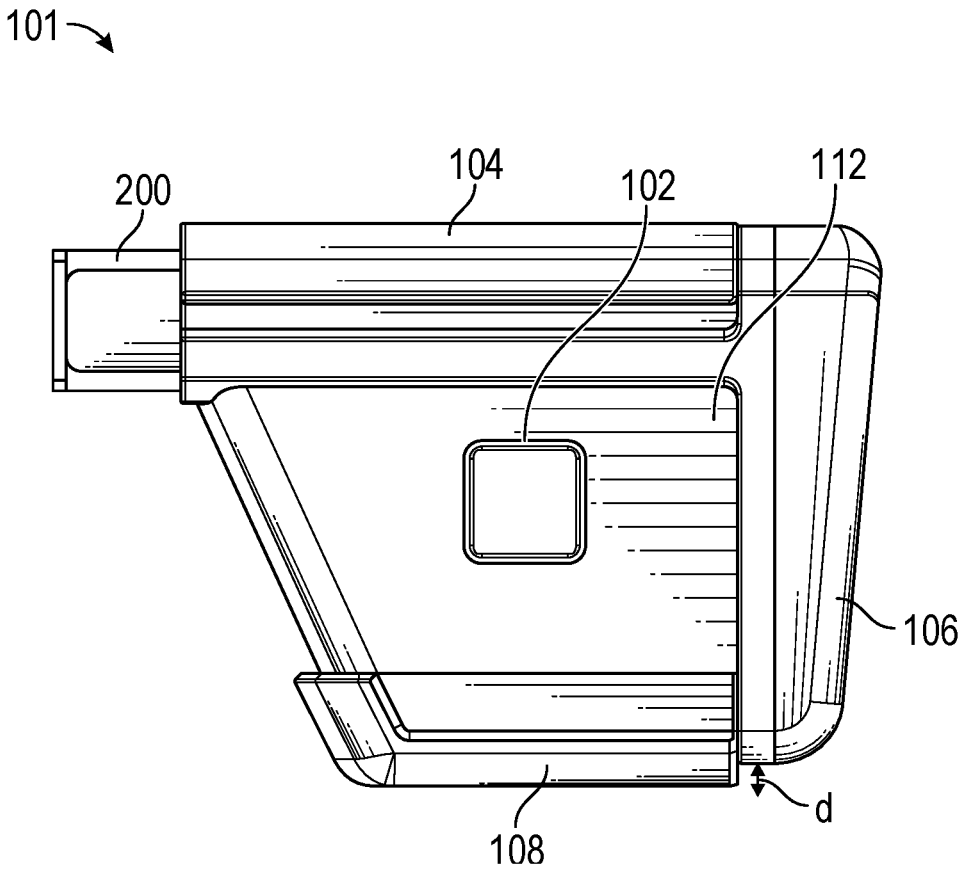
FIG. 9 is a side view with the bottom plate in a second position of a firearm stock with a cheek riser according to one or more examples of the disclosure.
Figure 10:
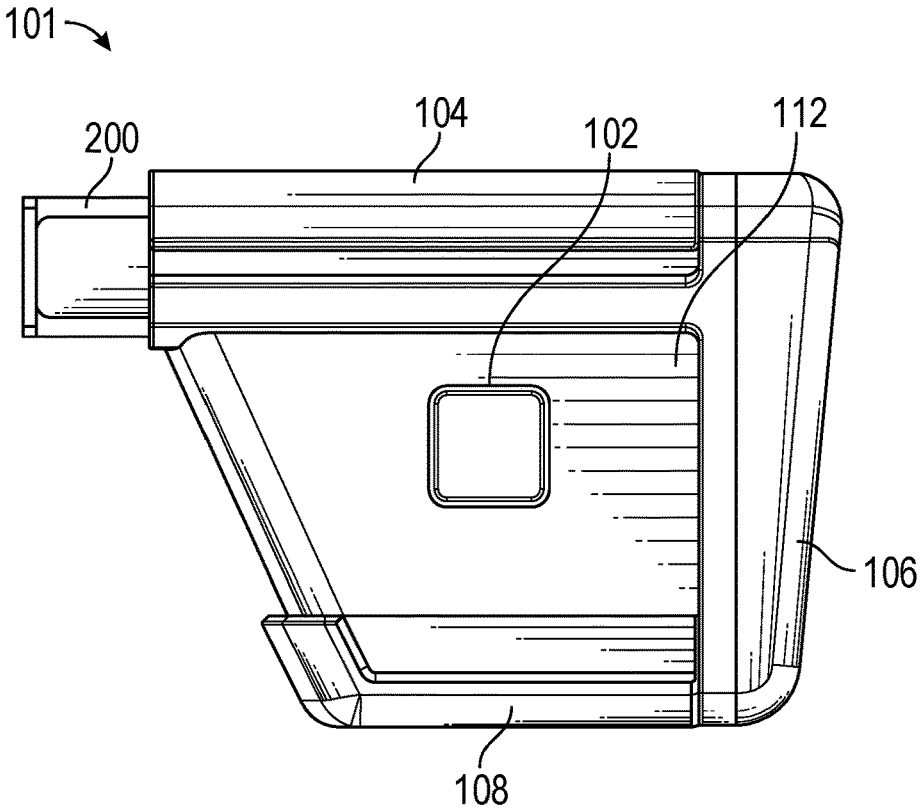
FIG. 10 is a side view with the bottom plate in a first position of a firearm stock with a cheek riser according to one or more examples of the disclosure.
Figure 11:
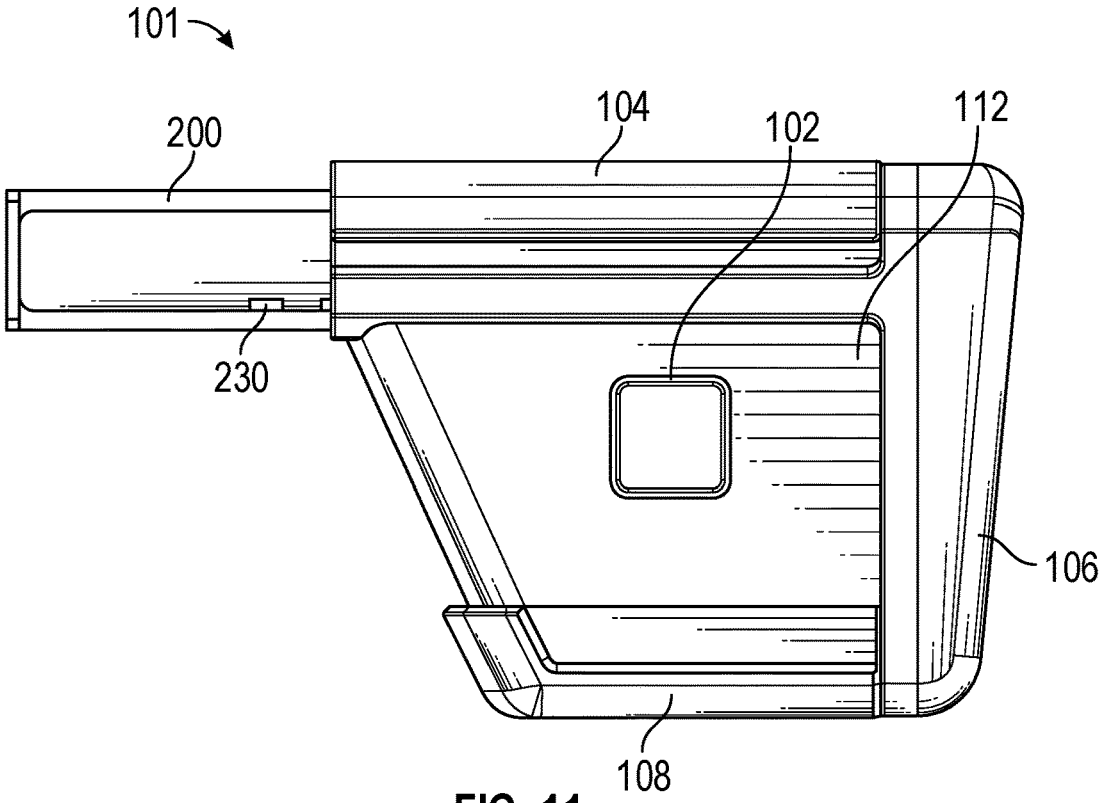
FIG. 11 is a side view of a firearm stock with a cheek riser with the I-beam extended according to one or more examples of the disclosure.
Figure 12:
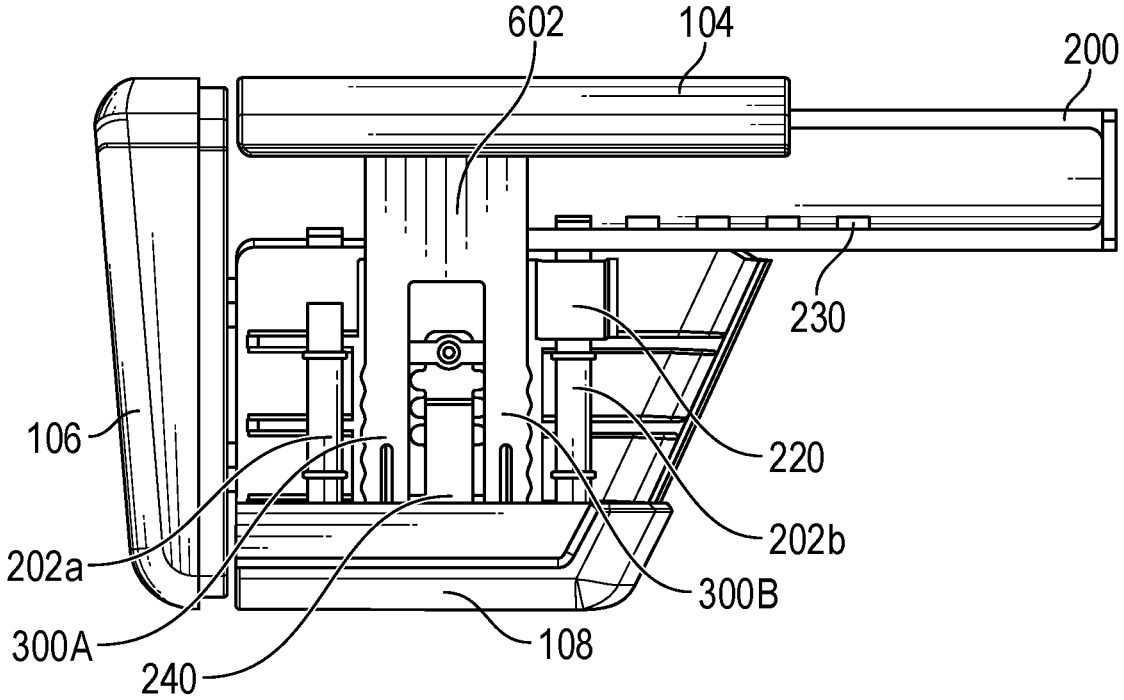
FIG. 12 is a left side view of a firearm stock with a cheek riser with one side removed and the bottom plate in a first position according to one or more examples of the disclosure.
Figure 13:
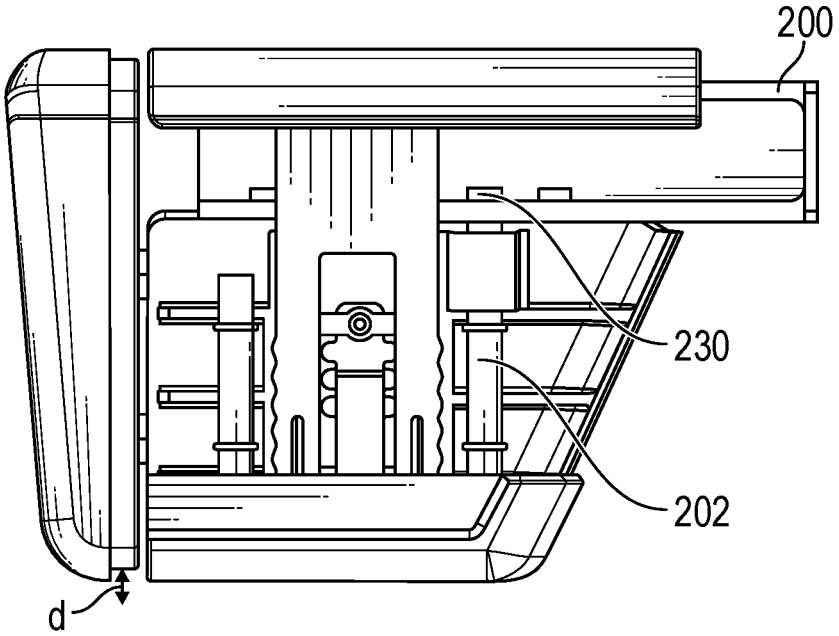
FIG. 13 is a left side view of a firearm stock with a cheek riser with one side removed and the bottom plate in a second position according to one or more examples of the disclosure.
Figure 14:
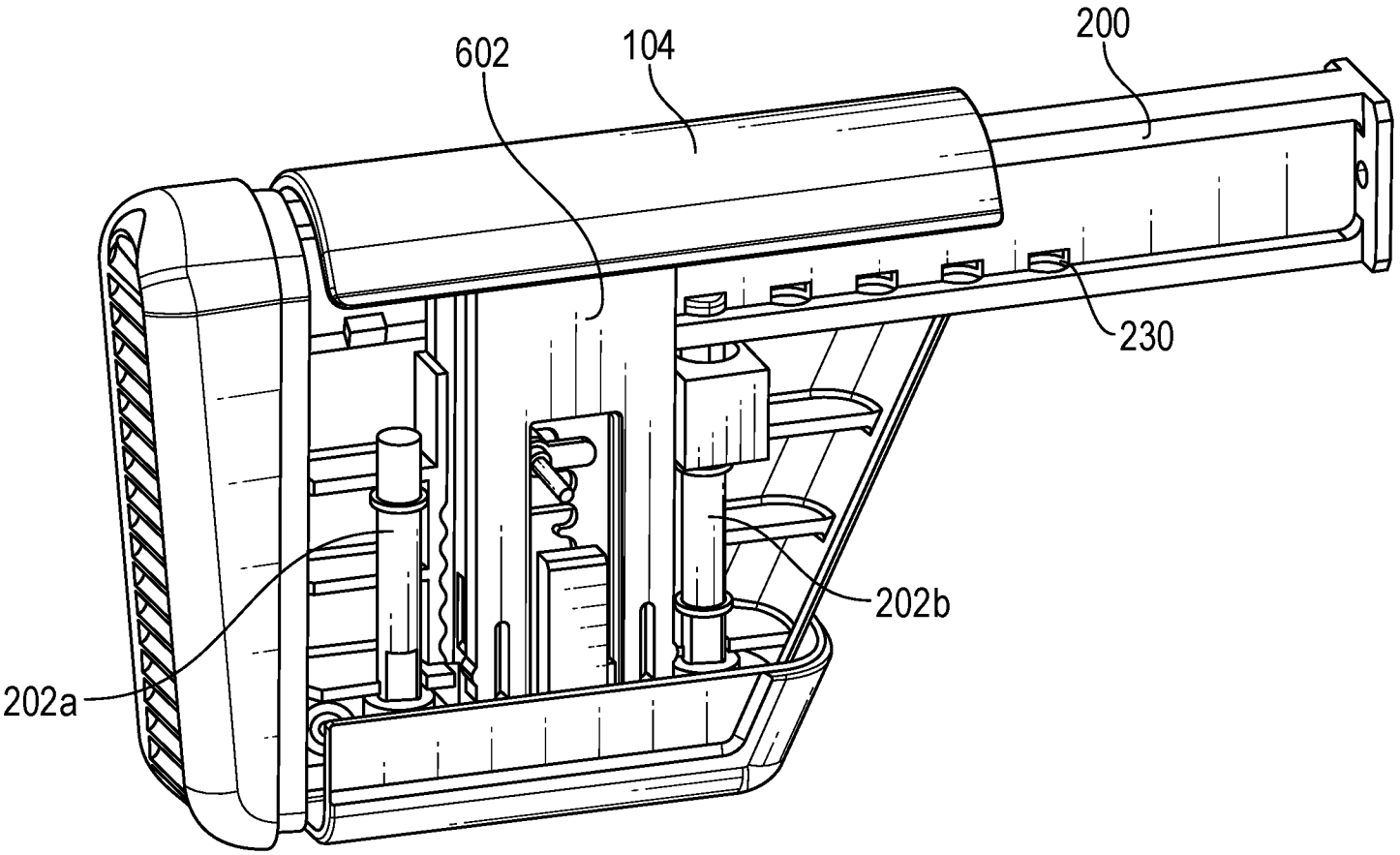
FIG. 14 is a perspective rear-left view of a firearm stock with a cheek riser with one side removed and the bottom plate in a second position according to one or more examples of the disclosure.
Figure 15:
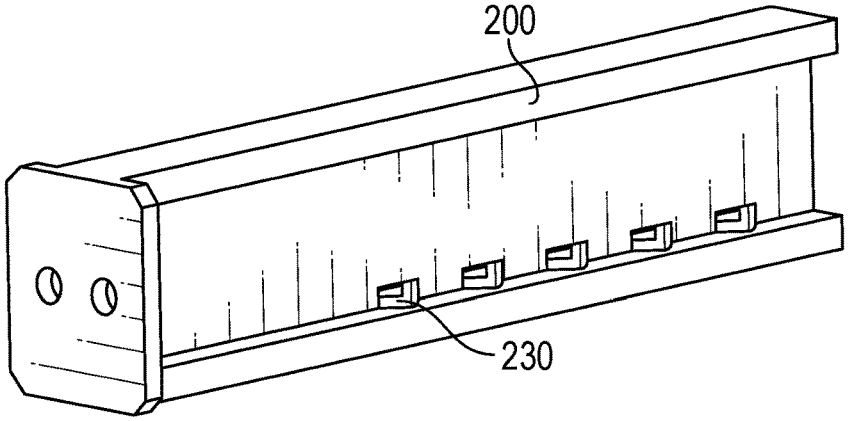
FIG. 15 is a perspective view of an I-beam insert according to one or more examples of the disclosure.

As shown in FIGS. 5-8, the pin 506 may be disposed within a recess 704 in the button mechanism 502. The pin 506 may be set into a recess 704 disposed within the button mechanism 502. The pin may be any shape configured to fit within the pinhole 250. A spring (not shown) may be disposed around the pin 506 and compress against the protrusion 255 to return the pin to a first position after being depressed. Stated another way, the spring disposed around the pin 506 may bias the button mechanism 502 to an extended position as shown in FIG. 7 and allow resisted movement as the button mechanism 502 is actuated to the compressed position as shown in FIG. 8.

As shown in FIGS. 5 and 6, apertures 508 may extend through the rising mechanism 602. The apertures 508 may be connected by a channel 510 running between the apertures. These apertures 508 (e.g. apertures 508*a*, 508*b*, 508*c* and 508*d* in FIG. 27), as shown in FIGS. 7 and 8, may be configured to engage with the first set of wings 702 (e.g., wings 702*a* and 702*b*) but not the second set of wings 504 (e.g., wings 504*a* and 504*b*). When the button mechanism 502 is compressed from a first position like FIG. 7 to a second position FIG. 8, the first set of wings 702 may be compressed by distance Q, shown in FIG. 8, to no longer engage with aperture 508*a*, such that the button mechanism 502 may slide up and down through the channel 510 and return to the first position where the first set of wings 702 may engage another aperture, such as the aperture 508*b*. The second set of wings 504 may limit a position of the button mechanism 502 while biased in an extended position responsive to compressed spring pressure compressed against the protrusion 302. Thus, the riser plate 104 may be adjusted up or down to the user's liking when the button 102 is depressed, and locked into position when the button is not depressed.

Methods of Use

In some embodiments, apertures 508 in the rising mechanism allow for adjustment of the cheek plate 104. The pin 506 and wings 504, 702 connected to the side button 102 are disposed within the apertures 508. The wings 504, 702 are fixedly connected to the side button 102. In between the wings 504, 702, a pin 506 is inserted into a recess 704. The wings 504, 702, pin 506, and side button 102 may be formed together, or formed as separate pieces and coupled. The apertures 508 allow for a first set of the wings 702 to engage a surface proximate to the edges of the apertures 508 to prevent movement of the button mechanism 502 along the channel 510 between the apertures 508. The pin 506 may be disposed within a spring inside either the pinhole 250 or the recess 704 to return the button mechanism to a repeated position.

In some embodiments, the rising mechanism has slits 620 in the bottom of it that allow for compression of the outer part of the slit. These slits 620 are configured such that the parts of the legs 300 on either side of it can be compressed. In some embodiments, the rising mechanism 602 includes two deformable U shaped legs 300*a*, 300*b*, each with slits 620 in them. The outside of these arms further comprises a protrusion 302*a*, 302*b* that fit into the ridges 402. In between the arms, a key 240 may be disposed to control the flex of each of the sides of the slits as well as the arms themselves.

In some embodiments, the stock 100 is configured to provide a customizable configuration of length of the total firearm as well as height of the cheek plate 104. Initially, the cheek plate 104 may be too low and the firearm shorter than preferred. To adjust the cheek plate, the side button 102 was pressed which compressed a spring within which the pin 506 is disposed, and compressed the wings 504, 702 further into the stock. The cheek plate 104 was then pulled vertically. Since the first set of wings 702 and second set of wings 504 were further disposed in the stock 100 and laterally outside of the apertures 508, the cheek plate 104 moved vertically along with the rest of the rising mechanism. The wings 504, 702 and pin 506 moved along the channel 510 between the apertures 508. The protrusions 302 at the outside of the slits 620 of the two legs 300 at the bottom of the rising mechanism moved from one ridge 402*a* to another ridge 402*b* as the force asserted vertically and the shape of the ridges 402 and protrusion 302 caused deformation of the slits. The key 240 in between the two arms of the rising mechanism controlled the deformation and ensured the protrusion 302 returned to the next ridge 402. The cheek plate 104 then stopped being pulled vertically. The key 240 and slits 620 of the rising mechanism pushed the protrusion 302 back into a ridge 402*b* that corresponded with an aperture 508*b* for a certain height of the cheek plate 104. The spring with the pin 506 disposed inside it then pushes on the pin, which pushes on the wings 504, 702 and side button 102 to return the first set of wings 702 into the aperture 508*b* to lock the cheek plate 104 into its new position.

To adjust the length of the stock, the bottom plate 108 of the stock 100 was pulled downward from a first position into a second position by distance d. The springs 204 compressed against the internal skeleton of the first side 112 and/or second piece 114. The rods 202 connected to the bottom plate 108 of the stock 100 moved downward with the bottom plate 108 of the stock 100. The rods 202 retracted from the bores 230 in the insert firearm frame member 200. The firearm frame member 200 was then pulled horizontally out the slot 110. Once the firearm frame member 200 reaches a desired position, the bottom portion (e.g., the bottom plate 108) of the stock 100 is stopped being pulled downward. The springs 204 expanded and returned the bottom plate 108 of the stock 100, and thus the rods 202, upwards. At least one rod 202b then inserts into other bores 230 to secure the firearm frame member 200 in its new position.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A firearm stock system, comprising:

a stock;

a firearm frame member positionally adjustable to the stock;

a bottom plate disposed in connection with the stock;

a first rod rigidly connected with the bottom plate, the first rod axially aligning the bottom plate to the stock when the bottom plate is moved from a collapsed position to an expanded position or from an expanded position to a collapsed position;

a second rod rigidly connected with the bottom plate;

a guide block axially aligned with the second rod, wherein the guide block is configured to guide the second rod to a bore of a plurality of frame member bores as the bottom plate moves from the expanded position to the collapsed position; and a first spring axially aligned with one of the first rod or the second rod, the first spring configured to bias the bottom plate to the collapsed position.

2. The firearm stock system of claim 1, further comprising:

a cheek riser;

a riser mechanism attached to the cheek riser and configured to adjust the cheek riser from a first position to a second position; and a button mechanism coupled to a pin and configured to actuate a movement of the riser mechanism;

wherein the rising mechanism includes a first aperture that engages the pin.

3. The firearm stock system of claim 2, wherein the riser mechanism comprises a second aperture and a third aperture configured to engage the pin.

4. The firearm stock system of claim 3, wherein the first aperture, the second aperture, and the third aperture further comprise an ovaloid cavity that engages the pin.

5. The firearm stock system of claim 4, wherein the pin comprises a first set of wings configured to engage the ovaloid cavity disposed on the second aperture to secure the cheek riser in a first position, wherein the first position is different from a second position of the cheek riser when the pin engages the first aperture.

6. The firearm stock system of claim 5, wherein the pin further comprises a second set of wings configured to limit a position of the button mechanism while the button mechanism and the pin is biased in an extended position.

7. The firearm stock system claim 1, further comprising a second spring axially aligned with another one of the first rod or the second rod, the second spring configured to bias the bottom plate to the collapsed position.

8. A firearm stock system comprising:

a cheek riser;

a riser mechanism attached to the cheek riser, wherein the riser mechanism comprises a plurality of apertures configured to adjust the cheek riser from a first position to a second position; and a button mechanism coupled to a pin and configured to actuate a movement of the riser mechanism;

wherein the riser mechanism includes a first aperture that engages the pin; and wherein the pin comprises a first set of wings configured to lock into a second aperture position from a first aperture position of the plurality of apertures during actuation of the button mechanism.

9. The firearm stock system of claim 8, wherein the riser mechanism comprises a second aperture and a third aperture configured to engage the pin.

10. The firearm stock system of claim 9, wherein the first aperture, the second aperture, and the third aperture further comprise an ovaloid cavity that engages the pin.

11. The firearm stock system of claim 10, wherein the pin comprises a first set of wings configured to engage the ovaloid cavity disposed on the second aperture to secure the cheek riser in a first position, wherein the first position is different from a second position of the cheek riser when the pin engages the first aperture.

12. The firearm stock system of claim 11, wherein the pin further comprises a second set of wings configured to limit a position of the button mechanism while the button mechanism and the pin is biased in an extended position.

13. The firearm stock system of claim 8, further comprising:

a stock;

a bottom plate disposed in connection with the stock;

a first rod rigidly connected with the bottom plate, the first rod axially aligning the bottom plate to the stock when the bottom plate is moved from a collapsed position to an expanded position or from an expanded position to a collapsed position;

a second rod rigidly connected with the bottom plate;

a guide block axially aligned with the second rod, wherein the guide block is configured to guide the second rod to a bore of a plurality of frame member bores as the bottom plate moves from the expanded position to the collapsed position; and a first spring axially aligned with one of the first rod or the second rod, the first spring configured to bias the bottom plate to the collapsed position.

14. The firearm stock system claim 13, further comprising a second spring axially aligned with another one of the first rod or the second rod, the second spring configured to bias the bottom plate to the collapsed position.

15. The firearm stock system of claim 8, wherein the riser mechanism further comprises a set of deformable arms configured to move in a channel; and wherein the riser mechanism comprises a first deformable arm having a first deformable arm protrusion and a second deformable arm having a second deformable arm protrusion.

16. The firearm stock system of claim 15, wherein the first deformable arm and the second deformable arm deform when the riser mechanism is moved in the channel from the first aperture position to the second aperture position and the first and second deformable arm protrusions interfere with channel side walls.

17. The firearm stock system of claim 16, wherein the riser mechanism further comprises a key disposed between the first and second deformable arms, the key configured to allow for vertical adjustment of the riser plate while limiting deformation of the deformable arms.

18. An adjustable firearm stock system comprising:

a stock;

a firearm frame member positionally adjustable to the stock;

a bottom plate disposed in connection with the stock;

a first rod rigidly connected with the bottom plate, the first rod axially aligning the bottom plate to the stock when the bottom plate is moved from a collapsed position to an expanded position or from an expanded position to a collapsed position;

a second rod rigidly connected with the bottom plate;

a guide block axially aligned with the second rod, wherein the guide block is configured to guide the second rod to a bore of a plurality of frame member bores as the bottom plate moves from the expanded position to the collapsed position;

a first spring axially aligned with one of the first rod or the second rod, the first spring configured to bias the bottom plate to the collapsed position;

a cheek riser; and a riser mechanism attached to the cheek riser, wherein the riser mechanism comprises a plurality of apertures configured to adjust the cheek riser from a first position to a second position; and a button mechanism coupled to a pin and configured to actuate a movement of the riser mechanism;

wherein the riser mechanism includes a first aperture that engages the pin; and wherein the pin comprises a first set of wings configured to lock into a second aperture position from a first aperture position of the plurality of apertures during actuation of the button mechanism.

19. The adjustable firearm stock system of claim 18, wherein the riser mechanism comprises a second aperture and a third aperture configured to engage the pin.

20. The adjustable firearm stock system of claim 19, wherein the first aperture, the second aperture, and the third aperture further comprise an ovaloid cavity that engages the pin.

21. The adjustable firearm stock system of claim 20, wherein the pin comprises a first set of wings configured to engage the ovaloid cavity disposed on the second aperture to secure the cheek riser in a first position, wherein the first position is different from a second position of the cheek riser when the pin engages the first aperture.

22. The adjustable firearm stock system of claim 21, wherein the pin further comprises a second set of wings configured to limit a position of the button mechanism while the button mechanism and the pin is biased in an extended position.

23. The adjustable firearm stock system of claim 22, further comprising a second spring axially aligned with another one of the first rod or the second rod, the second spring configured to bias the bottom plate to the collapsed position.

24. The adjustable firearm stock system of claim 18, wherein the riser mechanism further comprises a set of deformable arms configured to move in a channel; and wherein the riser mechanism comprises a first deformable arm having a first deformable arm protrusion and a second deformable arm having a second deformable arm protrusion.

25. The adjustable firearm stock system of claim 24, wherein the first deformable arm and the second deformable arm deform when the riser mechanism is moved in the channel from the first aperture position to the second aperture position and the first and second deformable arm protrusions interfere with channel side walls.

26. The adjustable firearm stock system of claim 25, wherein the riser mechanism further comprises a key disposed between the first and second deformable arms, the key configured to allow for vertical adjustment of riser plate while limiting deformation of the deformable arms.

* * * * *